US006558111B2

(12) United States Patent
Wilson et al.

(10) Patent No.: US 6,558,111 B2
(45) Date of Patent: May 6, 2003

(54) SYSTEM AND METHOD FOR UNLOADING BULK POWDER FROM LARGE BULK CONTAINERS

(75) Inventors: Catherine Marie Wilson, Wilmington, DE (US); Timothy Allan Bell, Wilimington, DE (US); John D. Connolly, Jr., Wilmington, DE (US); Peter Carl Clark, Diamond Head, MS (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/104,275

(22) Filed: Mar. 22, 2002

(65) Prior Publication Data

US 2002/0119032 A1 Aug. 29, 2002

Related U.S. Application Data

(62) Division of application No. 09/695,395, filed on Oct. 24, 2000.

(51) Int. Cl.[7] ..... B65G 65/00

(52) U.S. Cl. ..... 414/810; 406/38; 406/75; 414/800; 414/809; 414/403; 414/415; 414/363; 414/421; 220/1.5; 222/196; 222/203

(58) Field of Search ..... 414/467, 800, 414/809, 811, 812, 363, 403, 420, 421, 415, 575; 220/1.5; 222/203, 196; 406/38, 39, 75, 96

(56) References Cited

U.S. PATENT DOCUMENTS

| | | | | | |
|---|---|---|---|---|---|
| 2,229,037 | A | * | 1/1941 | Boldman | 414/525.7 X |
| 3,819,070 | A | * | 6/1974 | Clarke et al. | 414/362 |
| 3,951,284 | A | * | 4/1976 | Fell et al. | 220/1.5 X |
| 3,999,741 | A | | 12/1976 | Richards | |
| 4,175,906 | A | * | 11/1979 | Johnston et al. | 414/469 |
| 4,301,943 | A | | 11/1981 | Barends et al. | |
| 4,781,513 | A | | 11/1988 | Ajogren et al. | |
| 4,875,811 | A | | 10/1989 | Merrett et al. | |
| 4,941,779 | A | * | 7/1990 | Dewitz et al. | 406/138 |
| 5,017,053 | A | | 5/1991 | Sisk | |
| 5,096,336 | A | | 3/1992 | Merrett et al. | |
| 5,378,047 | A | | 1/1995 | Merrett et al. | |
| 5,547,331 | A | * | 8/1996 | Podd et al. | 414/293 X |

FOREIGN PATENT DOCUMENTS

| | | |
|---|---|---|
| DE | 3429167 A1 | 2/1986 |
| GB | 2 101 102 A | 1/1983 |
| RU | 505897 | 3/1978 |
| SU | 1009941 A | 6/1981 |

OTHER PUBLICATIONS

George P. Fotou, Quint H. Powell, Toivo T. Kodas, "Gas–Phase Coating of Titania with Metal Oxides in an Aerosol Flow Reactor", Center for Micro–Engineered Ceramics, Department of Chemical Engineering, University of New Mexico, Albuquerque, NM.

* cited by examiner

*Primary Examiner*—Frank E. Werner

(57) ABSTRACT

The present invention is directed to a system and a method to unload bulk powders from large bulk containers. The system and method are particularly useful for unloading bulk cohesive powders.

13 Claims, 4 Drawing Sheets

SYSTEM AND METHOD FOR UNLOADING BULK POWDER FROM LARGE BULK CONTAINERS

BACKGROUND OF THE INVENTION

Figures 1A, 1B:
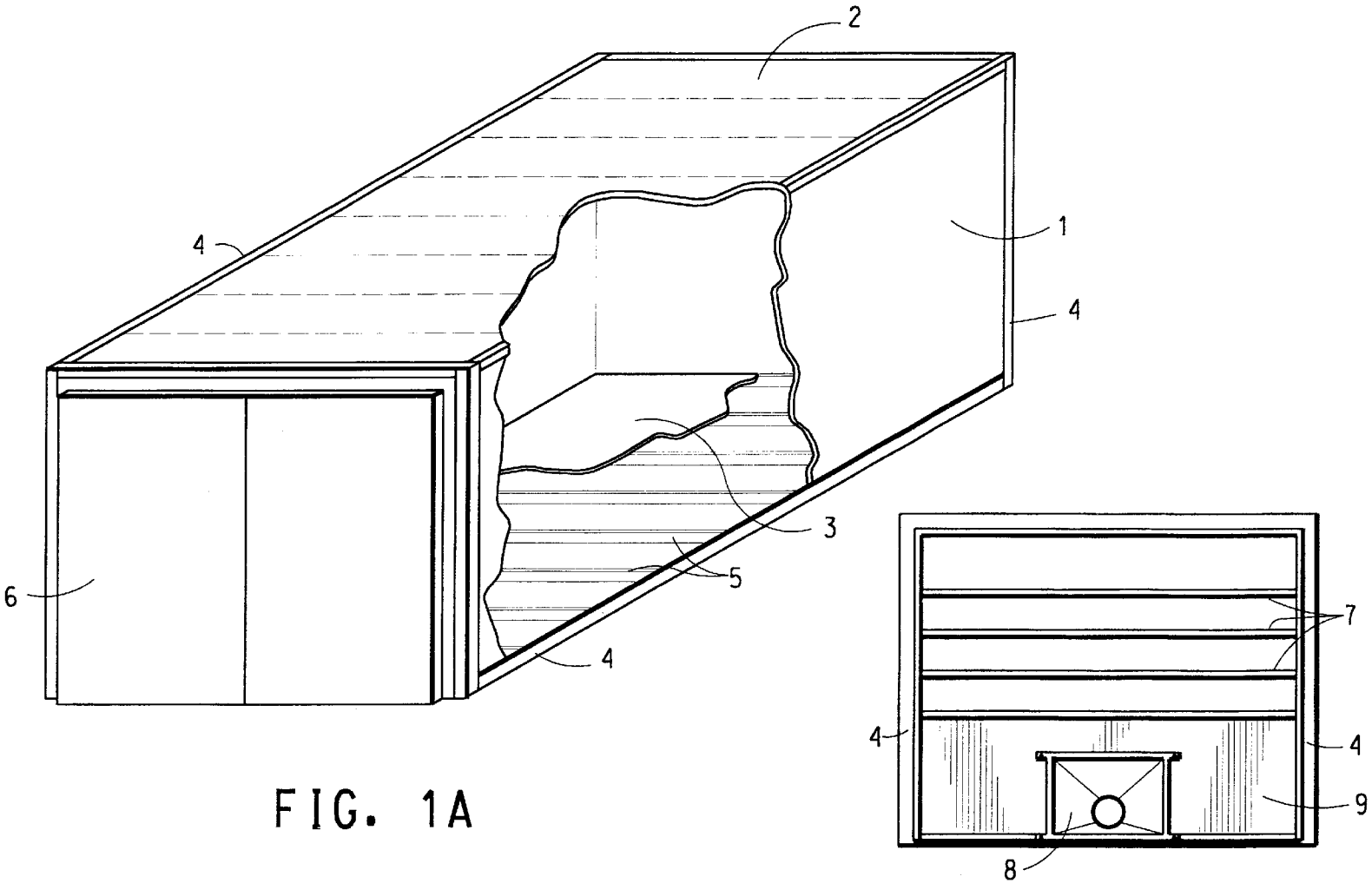

Transport of bulk powders from the manufacturing location to user location often pose problems particularly for powders that are by nature cohesive.

To transport bulk powders economically, they are typically shipped in metric ton bags commonly called semi-bulk containers (SBC's) or large bulk containers commonly called COFC's (container on railway flat car) or IMC's (intermodal containers). But, these alternatives have associated problems that increase transportation and handling costs, particularly for cohesive powders.

Use of SBC's offer efficiencies if the end user is willing to accept the SBC for direct use in their operations. If the end user prefers bulk delivery, the SBC must be dumped into large storage containers or into bulk trucks for delivery or use. This operation requires time and potentially represents some loss of product due to the incomplete emptying of the bag. The residual material (known as a heel) is often discarded with the bags.

IMC's may be used to efficiently transport bulk powders by rail or by sea, but on receipt at the receiving location the bulk powder must be transferred to storage or to bulk trucks for delivery. Economical unloading of bulk materials from IMC's at a transfer terminal or end user must be accomplished rapidly (ideally in one or two hours) in order to make effective use of labor and the expensive capital equipment needed to handle or unload the IMC. Any connection between the IMC and an unloading system must be made (and later removed) rapidly in order to minimize the impact on the total unloading cycle time. Spillage or airborne dust is not permissible due to product losses and environmental and housekeeping concerns.

Free flowing bulk materials such as plastic pellets and agricultural grains can easily be unloaded from IMC's containing 20 tons or more of material. Cohesive powders, on the other hand, are extremely difficult to unload from IMC's due to their bulk handling properties. These properties fall into four categories—dustiness, wall friction, gas permeability, and cohesive strength.

Discharging a load of cohesive bulk powder requires long times and presents unloading problems even when gravity unloading is assisted by the extensive use of vibrators or the use of pneumatic aeration systems. Such assisted unloading methods generally lead to dusting problems. Often, in spite of much effort directed to discharging all the powder stored in the IMC, substantial heels remain in the liner unavailable for use.

U.S. Pat. No. 3,999,741 teaches a method of unloading pigments from a bulk container by adding liquid to the container and removing the pigment as dispersion.

German Patent Publication DE 34 29 167 A1 teaches a method and apparatus for unloading a flexible container (such as a big bag) by placing the container on a vibrating element.

U.S. Pat. No. 4,781,513 teaches an apparatus for unloading and spreading a bulk material such as asphalt over the ground.

U.S. Pat. Nos. 4,875,811; 5,096,336; and 5,378,047 teach related inventions. In each case the invention is directed to unloading a bulk container using a pneumatic conveying apparatus. In the apparatus and process taught in these patents, bulk material such as polycarbonate resin is directed through a flexible conduit to a rotary valve that feeds the particulate material into a lower hopper for pneumatic conveying into a suitable storage facility.

U.S. Pat. No. 4,301,943 teaches a container and process to unload melamine powder from a bulk container. According to this patent melamine powder is unloaded through a discharge device having a hopper portion, a connector portion and a rotary pump assembly wherein certain hopper dimensions of angle, height and opening diameters are required.

The present invention provides an unloading system that is fully effective even with cohesive bulk powders such as pigmentary titanium dioxide.

BRIEF SUMMARY OF THE INVENTION

The present invention is directed to a bulk unloading system comprising:

(a) a bulk container removably mounted on a platform, the container having surrounding walls and a floor mounted on a structural frame and two ends, a front end and a rear end, wherein the front end is closed and rear end is least partially open; and the platform having a means of tilting the container at an angle from about 0 to at least 40 degrees;

(b) optionally a removable, flexible liner within the container where the bulk powder is sealed;

(c) optionally vibrators mounted on the container floor structural frame; and (d) a manifold having inlet and discharge sections, the manifold being mounted on the rear end of the container or on the platform, wherein at least a portion of the manifold is lined with a pneumatic conditioning membrane having a means of gas supply.

The present invention includes a method to unload bulk powder from a large bulk container removably mounted on a platform, the container having surrounding walls and a floor mounted on a structural frame and two ends, a front end and a rear end, wherein the front end is closed and rear end is least partially open, the powder being stored in the container or in a removable, flexible liner within the container; the platform having a means of tilting the container at an angle from about 0 to at least 40 degrees; and optionally vibrators mounted the container floor structural frame, the method comprising the steps of;

(a) connecting to the rear end of the container a manifold having a inlet and discharge sections wherein at least a portion of the manifold is lined with a pneumatic conditioning membrane having a means of gas supply;

(b) when the powder is stored within a liner, cutting the liner where the liner is exposed by the opening in the top plate of the manifold;

(c) tilting the container to an angle between 0 and at least 40 degrees;

(d) activating the pneumatic conditioning membrane by supplying gas to the membrane, with the proviso that if the angle of tilt is fixed and is an angle less than the angle of repose of the bulk powder the vibrators are activated.

BRIEF DESCRIPTION OF THE DRAWING(S)

FIG. 1-A shows a cutaway view typical IMC having a structural frame, channel ribs and doors.

FIG. 1-B shows the open rear end of a typical the IMC having bars inserted in the rear frame channel and having attached a manifold of the present invention.

Figure 2A:
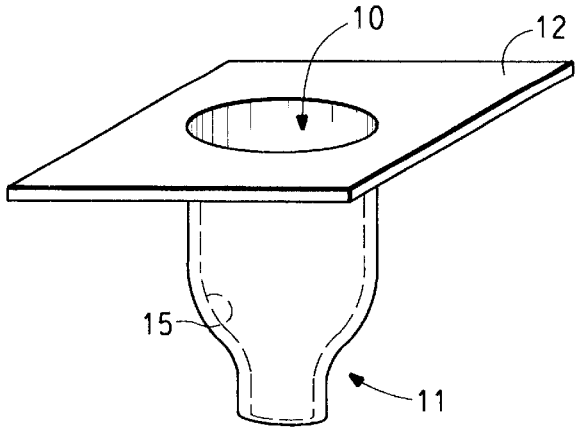

FIGS. 2A, B and C show some typical construction for the manifold used in the present invention.

Figure 3:
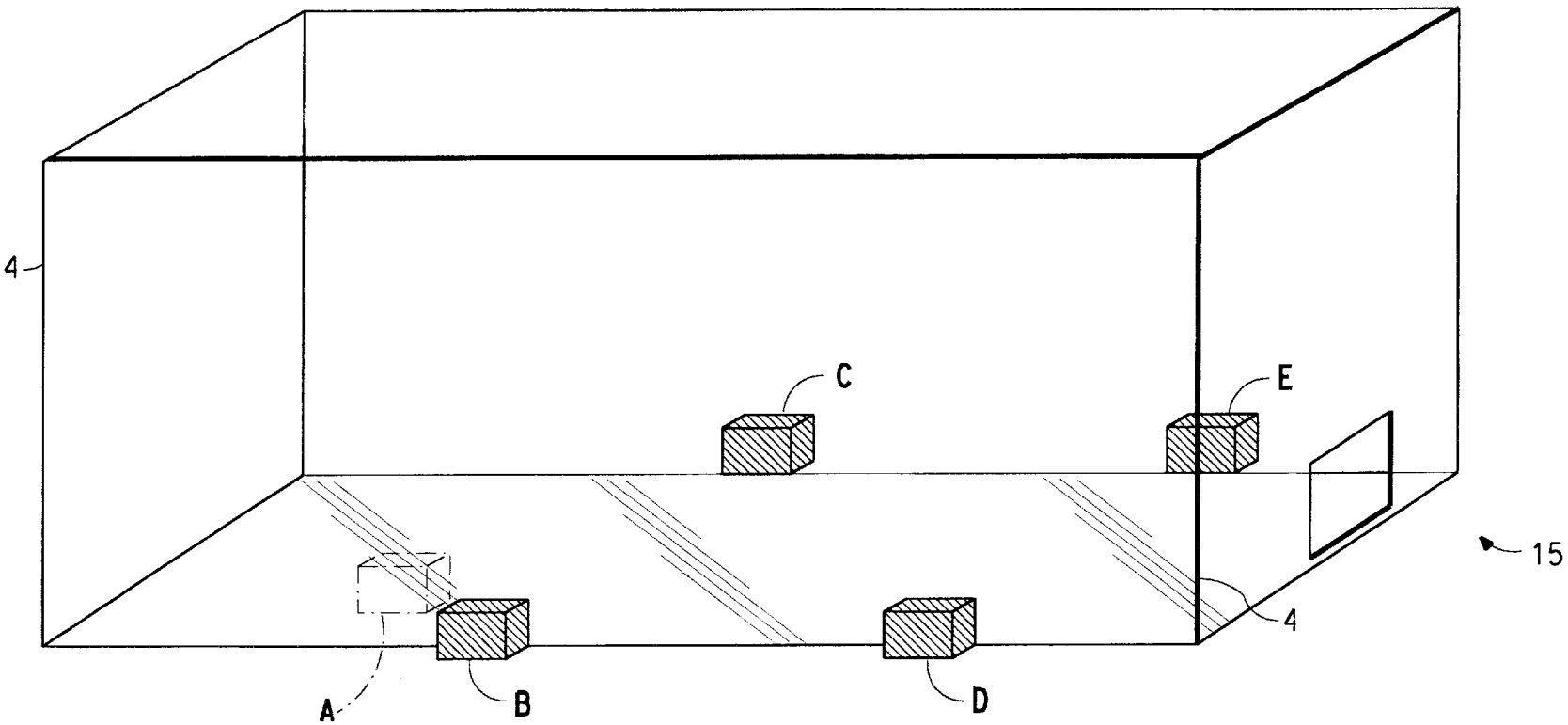

FIG. 3 shows the placement of vibrators according to the present invention.

Figure 4A:
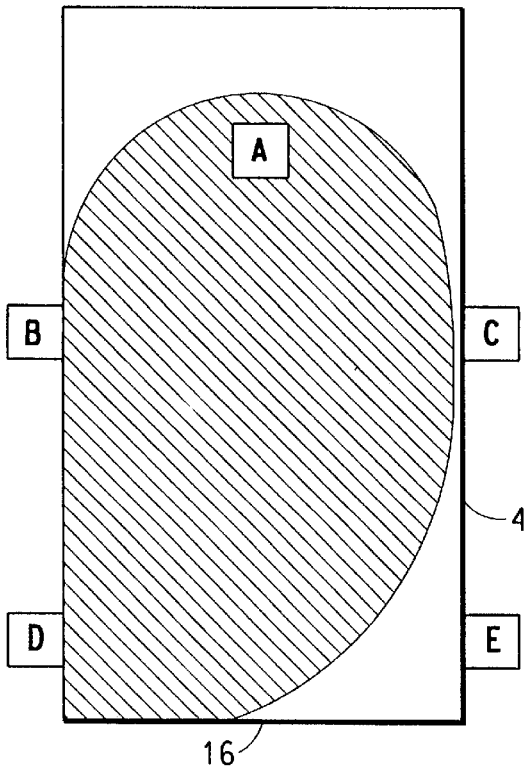

FIGS. 4A and B show the effective vibrator activation sequence of the present invention.

DETAILED DESCRIPTION OF THE INVENTION

The present invention is directed to a system and a method suitable for unloading bulk powders from a bulk container. The present invention is particularly useful for unloading bulk cohesive powders.

Bulk containers include containers known as intermodal containers used to transport bulk materials by rail, container ship, or truck. In the present invention it is preferred to use a standard removable container commonly known as a COFC or an IMC.

In transit, the bulk material is usually but not necessarily contained in a flexible plastic liner or bag. Such liners are usually made of vinyl or polyethylene. Typically when a liner is used, the liner is first placed within the container, and then filled with the powder to be transported. The liner protects the powder from contamination and also protects the IMC from contamination by the powder. Generally shipments made without liners are made using dedicated containers.

In the present invention a liner is not required, but if a liner is used, the liner may be what is referred to as a standard liner. A standard liner is one that has not been modified for use with cohesive powders. In fact, the present invention allows one to discharge even very cohesive powders such as pigmentary titanium dioxide from a standard liner with or without the assistance of vibrators. In contrast special liners such as aerated liners are usually required for delivery of cohesive powders.

As shown in FIG. 1A, IMC's are constructed from side walls 1, a roof 2, and a floor 3 mounted on a 10 structural frame 4. In the floor section, and sometimes the top section, the structural frame has cross members 5, usually made from metal. The floor is usually made from wood. The structural frame is usually made from metal or other sturdy materials.

The IMC has two ends. One end of the container, usually referred to as the rear end, has a pair of doors that are closed during transit as shown as 6 in FIG. 1A. When opened, the doors expose the open or partially open rear end as seen in FIG. 1B. During shipment, the doors are closed and a cardboard bulkhead blocks the opening in the rear end of the container. This bulkhead may also be supported by steel or wooden bars 7 inserted into a rear channel of the structural frame. In FIG. 1B, a hopper-shaped manifold 8 of the present invention attached to the rear end of the container by a support member 9 that covers about third of opening in the rear end of the container.

The bulkhead, in turn supports flexible liner. The bulkhead has an opening in it through which the powder can be discharged once the liner is cut.

The liner is typically filled through openings in its top using flexible hose extensions. Once filled, the top of the liner or the extensions are closed. The configuration of the container to accommodate the filling of the liner is not critical to the present invention.

When the loaded bulk container arrives at its destination, it is usually placed on a platform capable of tilting the container to allow for gravity discharge of the bulk powder. Platforms may be fixed or mobile. Before the powder is discharged, the liner, if one is used, is cut to allow the powder to discharged through the opening in the bulkhead.

The present invention is directed to a bulk unloading system comprising:

A bulk unloading system comprising:

(a) a bulk container removably mounted on a platform, the container having surrounding walls and a floor mounted on a structural frame and two ends, a front end and a rear end, wherein the front end is closed and rear end is least partially open; and the platform having a means of tilting the container at an angle from about 0 to at least 40 degrees;

(b) optionally a removable, flexible liner within the container where the bulk powder is sealed;

(c) optionally vibrators mounted on the container floor structural frame; and (d) a manifold having inlet and discharge sections, the manifold being mounted on the rear end of the container or on the platform, wherein at least a portion of the manifold is lined with a pneumatic conditioning membrane having a means of gas supply.

The manifold useful in the present invention may be used in various applications where bulk powders are to be transferred from one location to another. It is simple in its construction, but provides an easy flow, liquid-like discharge of bulk powders, even cohesive powders. It is surprising that the combination of the present invention is so effective in unloading bulk powders since, by far, the largest portion of the bulk powder has no contact with the manifold's pneumatic conditioning membrane; and yet the unloading system of the present invention allows even cohesive powders be emptied rapidly leaving little if any heel.

When used with cohesive powders such as titanium dioxide, the manifold allows the powder to discharge while the pneumatic conditioning membrane is activated, but the flow stops or becomes erratic when the gas or air supply to the membrane is shut off.

Considering the manifold, its size and shape are not critical. Neither is the shape of the openings in the manifold or that of the bulkhead critical in the present invention. The shape and size of the various openings and the shape and size of the manifold may be adapted to be those that are suitable the bulk container or to other equipment in use at the delivery site.

The manifold of the present invention, for practicality, should be of manageable size and shape. A hopper-shaped manifold is preferred. That is one of converging walls so that the inlet opening is larger than the discharge opening. The inlet section of the manifold is connected to the rear end of the container. As the powder is unloaded, it flows from the container through the inlet section and discharges through the discharge section. For example, a hopper-shaped manifold having walls which converge from the inlet opening to the discharge opening, such as the various shapes shown in FIGS. 2A, B and C, provide control in directing the flow of the powder. In addition, the discharge section 11 may be designed such that it is sized to fit standard hose materials while the inlet section (including an inlet opening 10 and support member 12, 13 and 14 respectively in FIGS. 2A, 2B, and 2C) may be sized to so that the inlet opening fully cover the opening in a liner's bulkhead, and any support member may be adapted to provide suitable support for the manifold.

The manifold useful in the present invention employs a pneumatic conditioning membrane shown as 15 in FIGS. 2A, B, and C. As used herein, the term "pneumatic conditioning membrane" means a porous surface through which air or some other suitable gas is fed. This material is sometimes referred to as permeable media/membrane. The preferred material to use for the conditioning membrane of the present invention is a microporous membrane material such as that manufactured under the trademarks DYNAPORE and TRANSFLOW, microporous membrane. A microporous membrane material contains a multitude of small holes, less than 0.030 mm in diameter, spaced closely together. The pathway by which the gas passes through the membrane is tortuous, resulting in a measurable resistance to the flow of gas. These membranes may be formed from cloth felt, polymers, sintered metal, or metal laminates.

Other permeable media/membranes suitable for use in the present invention include flow promoting devices which use the momentum of pulsing compressed air to maintain the flow of powders along the walls of a pipe or hopper such as air sweeps or air pads. Manufacturers of air sweeps and air pads include Myrlen and Solimar.

Pneumatic conditioning membranes may be selected to meet requirements of specified powders. Gas flow rates to the membrane may also be adjusted to be suitable for discharging a particular powder. The optimal gas flow rate and membrane selection may be found by experimenting. Selection may be dictated by the balance of dusting produced by the flow conditioning and the desired rate of bulk powder discharge.

Gas flow to the pneumatic conditioning membrane may be supplied as air or an inert gas by a compressor, liquefied gas storage facility, or another source of compressed gas. If a compressor is used, the compressors may be fixed or portable, and may be located at the unloading platform or a large central location at an unloading facility.

The membrane is referred to as a conditioning membrane because the gas flow at the membrane/powder interface is not sufficient to cause fluidization of the powder. In spite of the fact the powder is not fluidized, the gas flow through the membrane enhances the flow of the bulk powder not only in the manifold itself, but throughout the entire mass of powder in the container.

Figure 2B:
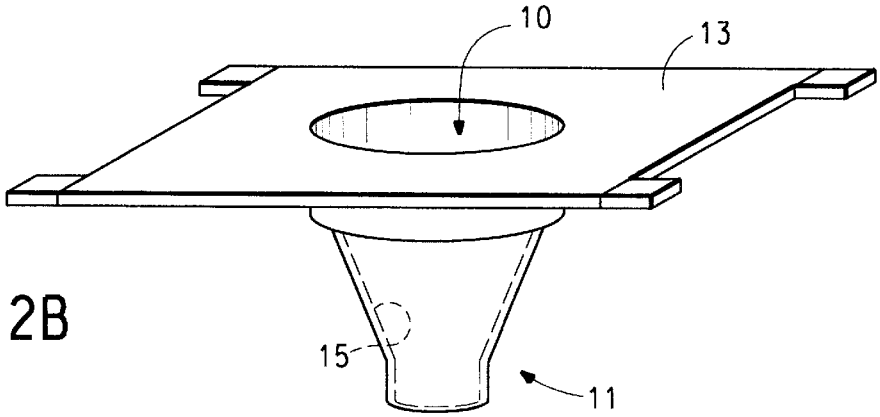
Figure 2C:
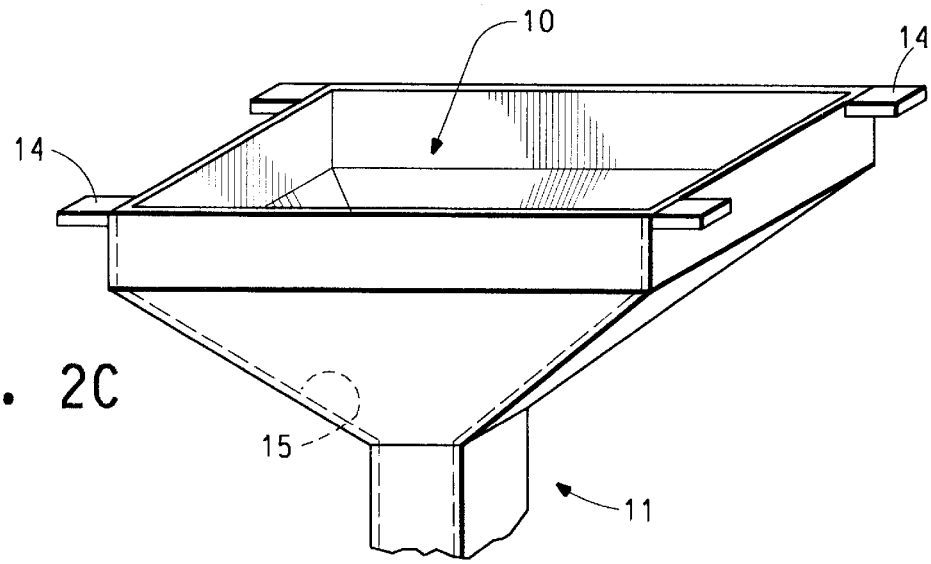

The manifold may be mounted on the rear end of the container or may be mounted on the platform. In each case the manifold may be mounted removably or rigidly. It is preferred that the manifold be mounted by the inlet section removably to the rear end of the container. This connection or mounting need not be fast. For example, the manifold may be attached to a large bulkhead support plate, as represented in FIG. 2B, that maybe moved into position hydraulically to support the rear bulkhead and position the manifold simultaneously. Such a support plate might be hinged or otherwise permanently mounted to the tilting platform. The manifold may also be mounted to a frame which is lifted into position, such as one that hooks into mounting holes that are located in the top corners of many IMC's. By using such an overhead means of support, the manifold is hung down into position over the IMC discharge opening.

The inlet section of the manifold may be joined to a support member as shown in FIGS. 2A, B, and C and in FIG. 1B. The support member may vary in size and shape as needed to provide suitable support for mounting the manifold. In FIG. 1B, for example, the support member 12 covers the entire lower portion of the rear end of the container. The support member of the manifold may simply be a flange to connect the manifold to the rear end of the container, or the support member may be sized to cover fully the rear end of the container.

For powders with high bulk densities, or in containers used without liners, or for situations where one desired to use a tilt angle in excess of the angle of repose of the powder to be unloaded, a support member sized to cover the entire rear end of the container also provides reinforcement for the cardboard bulkhead.

Restraining bars (7 of FIG. 1A) are necessary to keep the cardboard bulkhead from bulging out when the container doors are open. The bulk powders exert a pressure on the bulkhead. This pressure is increased during tilt unloading. The restraining bars are a cost item for bulk shipment, since they are usually thrown away or scrapped at the receiving end.

The embodiment of the present invention having the support member sized to cover and support the entire rear bulkhead or rear end of the container may reduce or eliminate the cost of the restraining bars and their installation. The manifold with its support member may be attached to rigging points in the corners of the container. Alternatively, the hopper/support member might be built into the tilt stand. That is, removably or rigidly mounted to the platform.

Air or gas service to the pneumatic conditioning membrane may be supplied through a service port on the manifold. This service port may be placed at any convenient location on the manifold.

Optionally the container may be fitted with vibrators. The use of vibrators is not essential in the unloading of the container, but may be useful in certain situations. For example, when the angle of tilt is less than the angle of repose of the bulk powder throughout the entire unloading operation, vibrators are useful in "walking" the powder towards the manifold. This action eliminates the formation of ratholes and other open regions as the powder is discharged from the container.

If vibrators are to be used in the present system, at least 3 vibrators are preferred in the present system; and the use of five most preferred. The vibrators are rigidly mounted on the container floor structural frame channels shown in FIGS. 1, 2 and 3.

The following recommendations are preferred for unloading the container using vibrators. When 3 vibrators are used, 2 of the vibrators are mounted as a pair, one directly opposite the other. The third vibrator is mounted on a cross member of the structural frame along the container floor centerline at a location between the front end of the container and the pair of vibrators. When 5 vibrators are used, the vibrators are mounted so that there is a first pair of vibrators at the rear end of the container, and a second pair of vibrators mounted approximately halfway between the container's front end and the rear end. The fifth vibrator is mounted on a cross member of the structural frame along the container floor centerline at a location between the front end of the container and the second pair of vibrators. FIG. 3 shows the recommended mounting pattern for 5 vibrators, and FIG. 4-A shows the location pattern for 5 vibrators and 4-B shows the vibrator activation sequence recommended.

The platform used in the present invention is essentially a means to tilt the container. By tilting is meant that the front end of the container is raised above the rear end. The angle of tilt is the angle formed between the base of the container and the ground or between the base of the container and the frame of the platform. The term "platform having a means of tilting" includes devices such as a inclined structure, ramps, a lifting fifth wheel, a tilt trailer, a truck tilting platform, a crane and other means to hoist the front end of the container above the rear end or stationary tilt platform.

As used herein "a cohesive powder" is a powder classified as a type C or A powder according to the Geldart classification.

The behavior of particle systems interacting with a gas stream is often described using a criterion developed by Geldart (Powder Technol. 7, 285–292, 1973). In Geldart's criterion, particle assemblages are described by their mean diameter and particle density. Geldart characterizes four categories, identified as A, B, C and D. The larger, denser particles, such as grains of rice, dry sand and table salt (average size larger than 0.150 mm), fall into Geldart's categories B and D. Such materials can be easily delivered and metered by a variety of means. Smaller, lighter particles will fall into categories C and A. Particle systems with mean particle diameters less than approximately 0.020 mm generally are considered to be category C (or cohesive), regardless of their density. Essentially all pigments fall into this category. Particle systems with mean diameters between 0.020 mm and 0.150 mm may be category C or category A (aeratable) depending on their density and other factors influencing interparticle forces and interactions with gas streams. Particle systems that are aeratable can sometimes be fluidized with a counter-current gas flow, and can be delivered and metered in a fluid-like state. However, the gas flow rates required for fluidization can be significant, leading to dusting problems and gas supply limitations. In addition, only a small proportion of powders of industrial interest are actually aeratable.

For bulk powders in Geldart class "C" and "A" cohesive strength becomes a major issue. Particles develop attachments to each other in response to gravitational compressive forces and vibration and settlement over time. This cohesive strength is sufficient to cause the powder to form arches and ratholes inside the IMC and any associated discharge hopper. In some circumstances, these self-supporting powder structures may be several feet wide, making it impossible to unload an IMC through any closed, converging hopper via gravity alone. The strength and size of the powder structures that develop during discharge attempts is influenced by the shape of the discharge hopper. Shallow hoppers create stress distributions in the bulk of the powder that tend to encourage the formation of ratholes and stagnant areas (heels) remaining in the corners or elsewhere at the completion of the IMC emptying. These problems can sometimes be reduced by the use of a long, steep-sided hopper. However, such hoppers are impractical for unloading an IMC because the hopper becomes large and unwieldy. In addition, they may also restrict the range of tilt angles that can be achieved. Powders with very high wall friction, such as pigmentary titanium dioxide, require extremely steep hoppers and pose a particular challenge.

Some cohesive powders may not slide readily toward the rear of the container. They may also form self-supporting piles or other structures part-way between the front of the container and the rear. Tilting of the container at a steeper angle will sometimes be sufficient to initiate front-to-rear flow, but excessively steep angles may exceed the design capacities of tilting equipment, and may also cause periodic "landslides" to dislodge from the front of the container and fall with appreciable force toward the rear, causing undesirable compaction of the powder in the region of the discharge hopper. In addition, highly frictional powders (such as pigments) will tend to drag against the IMC's liner and may tear it lose from its anchoring if the IMC is tilted excessively.

In the prior art, hopper design offered little in the way of solving unloading problems. For example, as a hopper gets wider or taller, and its outlet valve gets larger, it becomes increasing difficult to handle the hopper and fit into place on the container. Hoppers generally converge from their inlet diameter to the outlet diameter. If the convergence is very rapid (forming a short, shallow hopper) discharge problems as described in the paragraphs above can be expected. If the convergence is very gradual (forming a long, steep-sided hopper) discharge problems are reduced but the hopper becomes very large and difficult to handle. In addition, with a steep-sided hopper, the hopper may contact the ground or support structure during tilt unloading with conventional apparatus.

The present invention provides a method of unloading a bulk container that circumvents these problems common in unloading processes according to the prior art.

The present invention provides a method to unload bulk powder from a large bulk container removably mounted on a platform, the container having surrounding walls and a floor mounted on a structural frame and two ends, a front end and a rear end, wherein the front end is closed and rear end is least partially open, the powder being stored in the container or in a removable, flexible liner within the container; the platform having a means of tilting the container at an angle from about 0 to at least 40 degrees; and optionally vibrators mounted the container floor structural frame, the method comprising the steps of;

(a) connecting to the rear end of the container a manifold having a inlet and discharge sections wherein at least a portion of the manifold is lined with a pneumatic conditioning membrane having a means of gas supply;

(b) when the powder is stored within a liner, cutting the liner where the liner is exposed by the opening in the top plate of the manifold;

(c) tilting the container to an angle between 0 and at least 40 degrees;

(d) activating the pneumatic conditioning membrane by supplying gas to the membrane, with the proviso that if the angle of tilt is fixed and is an angle less than the angle of repose of the bulk powder the vibrators are activated.

In the method and system of the present invention, the use of vibrators is not necessary unless the angle of tilt is fixed and less than the angle of repose of the bulk powder. When the angle of tilt is fixed, meaning that it cannot be increased during the unloading operation; and when the angle of tilt is less than the angle of repose of the bulk powder; strategically placed vibrators may be used to "walk" the powder in the direction of the manifold. At an angle of lift less than the bulk powder's angle of repose, the bulk powder near the front end of the container may not move towards the manifold and actually become separated from the mass of powder moving towards the manifold. It appears for best results in both rapid and complete discharge of the bulk powder that at least some portion of the powder must be in contact with the mass of powder flowing under the influence of the pneumatic conditioning membrane. This powder that may become separated from the mass of powder flowing under the influence of the pneumatic condition membrane may be encouraged to cascade down from the front end of the container by either increasing the tilt angle to an angle greater than the angle of repose or by using vibrators to assist the powder's movement. The use of vibrators may not need to be continuous. The frequency at which vibrators are activated will depend on the nature of the powder being discharged.

Figure 4B:
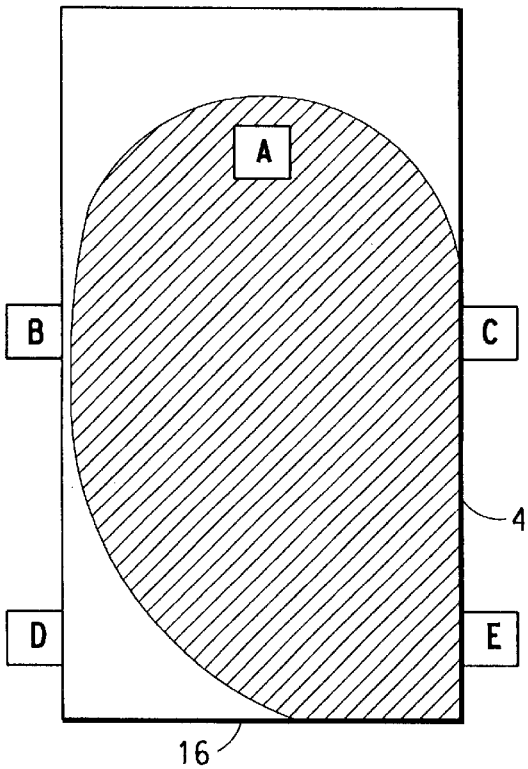

An example of situation where the use of vibrators is necessary is the unloading of titanium dioxide pigment at a tilt angle of 20 degrees or less. In this case it is preferred that there be 5 vibrators mounted on the container floor structural frame, the vibrators mounted so that there is a first pair of vibrators at the rear end of the container, a second pair of vibrators mounted approximately halfway between the front end and the rear end of the container, and the fifth vibrator mounted on a cross member of the structural frame along the container floor center line at a location between the front end of the container and the second pair of vibrators. The vibrators are activated in sequential patterns. In the first pattern the fifth vibrator, the second pair and only one vibrator of the first pair are activated together. In the second pattern the fifth vibrator, the second pair vibrators and the other vibrator of the first pair are activated together. This preferred placement of vibrators is shown in FIG. 3, and the sequence patterns of activation are shown in FIGS. 4A and 4B. In FIG. 3, the support frame 4 and cross members 5 of the container serve as the location for mounting the vibrators. This concentrates the vibrational energy on the floor of the container. The vibrators are shown as shaded boxes in the Figure. Vibrators according to the present invention are positioned on the outside of the container and attached to the heavy channel rails and the cross members of the support frame under the floor of the container.

The activation sequence is shown in FIGS. 4A and B as a stylized view looking from below the structural frame supporting the container floor. In this view, 1 denotes the rear end of the container, 2 the floor structural frame with cross members 3, and the vibrators are shown a boxes a, b, c, d, and e. In the activation pattern, drive power is provided to only those vibrators in the shaded region. In one pattern drive power is provided to vibrators a, b, c, and d. In the other pattern drive power is provided to vibrators a, b, c, and e. One alternates between these patters during unloading. The term activation means that the vibrators are vibrating. Drive power to the vibrators may be electric or air. Typical vibrators useful in the present invention include vibrators manufactured by Vibco, such as model 570 and 2000.

According to the present invention the use of vibrators can be completely avoided by raising the container so that the angle of tilt that is equal to or greater than the angle of repose of the bulk powder. One way to do this is to set the tilt angle to be at least equal to the angle of repose of the bulk powder, and as the powder discharges to increase the angle of tilt to allow the powder to discharge. This process allows the powder to shift its mass so that the mass is supported more by the card board bulkhead than by the floor of the container. As the powder flows out of the container under the influence of the conditioning membrane, more powder flows into the conditioning region replacing the powder that flowed out of the container. This conditioned flow will continue until the powder has been discharged.

The use of such a variable tilt angle may be accomplished at intervals which may be separated by some definite time or be such small, incremental steps as to be continuous. The rate at which the angle is increased depends on what works best with the particular bulk powder being unloaded. If powder becomes trapped in a fold formed in the plastic inner liner, one may use a single vibrator to scavenge this powder.

A second way to unload the container is to tilt the container in a single motion so that in step (c) the container is tilted immediately at an angle greater than the angle of repose to discharge the bulk powder. In this situation it is recommended to use a manifold having a top portion that fully covers the rear end of the container. This will avoid damaging the cardboard bulkhead. For rapid unloading of a very cohesive powder such as titanium dioxide powder, this last embodiment of the present method is preferred.

The present system and method may be used with any bulk powder. When a liner is used in the bulk container, this liner may be of any type. A particular advantage of the system and method is that standard liners and equipment may be used even when the bulk powder being unloaded is particularly cohesive.

The following Example and the Figures are intended to illustrate the present invention without limiting the invention to this specific Example or Figures.

EXAMPLE

The following example illustrates the use of the system of the present invention. An IMC with a standard liner containing 21 tons of titanium dioxide pigment was unloaded after a shipment time of 2–3 weeks in a cargo ship. The angle of repose of the pigment used in this test was 37–38 degrees.

At the delivery location, the container doors were opened and a manifold according to the present invention lined with permeable media/membrane material connected to the rear end of the IMC. In this Example the pneumatic conditioning membrane was TRANSFLOW, microporous membrane. (TRANSFLOW is a trademark of Young Industries of Muncy, Pa.).

The container was prepared for unloading by opening the rear doors and cutting the liner so that the pigment powder could discharge through the opening in the cardboard bulkhead. The air supply to the pneumatic membrane was started and the container was tilted to an angle of 35–40 degrees using a stationary tilting platform. The container exhibited an unloading rate of 5 metric tons/minute. Vibrators were not used in the primary unloading operation although one vibrator was used to scavenge the heel. The liner was removed to examine it for any pigment powder remaining. All of the pigment powder was unloaded except for a portion weighing not more than 100 pounds that was captured in a fold of the liner.

What is claimed is:

1. A method to unload bulk powder from a large bulk container removably mounted on a platform, the container having surrounding walls and a floor mounted on a structural frame and two ends, a front end and a rear end, wherein the front end is closed and rear having doors, the powder being stored in the container and the container having a means of tilting at an angle from about 0 to at least 40 degrees wherein the tilting means is selected from the group consisting of an inclined structure, ramps, a lifting front wheel, a tilt trailer, a truck tilting platform, a stationary tilt platform and a crane to hoist the rear end of the container higher than the front end; and vibrators mounted outside of the container and attached to heavy channel rails and cross members supporting the floor of the container, the method comprising the steps of;

(a) connecting to the rear end of the container a manifold having a inlet and discharge sections the manifold being mounted by a support member connected to a location selected from the group consisting of the rear end of the container and the platform in order to connect the inlet of the manifold to rear end of the container, and wherein at least a portion of the manifold is lined with a pneumatic conditioning membrane and wherein on the manifold is a service port by which gas service is supplied to the pneumatic conditioning membrane in order to enhance the flow of the bulk powder in the manifold and throughout the powder's entire mass;

(b) tilting the container to an angle between 0 and at least 40 degrees;

(c) activating the pneumatic conditioning membrane by supplying gas to the membrane, with the proviso that if the angle of tilt is fixed and is an angle less than the angle of repose of the bulk powder the vibrators are activated wherein activated means that the vibrators are vibrating by means of electric or air power drive to walk the powder in the direction of the manifold.

2. The method of claim 1 wherein the support member is sized to cover fully the rear end of the container.

3. The method of claim 1 wherein a means of gas supply is selected from the group consisting of a portable compressor, fixed compressor, and a source of compressed gas.

4. The method of claim 1 wherein the manifold is hopper-shaped.

5. The method of claim 1 wherein the manifold is connected to the rear end of the container by being removably mounted on the rear end of the container.

6. The method of claim 1 wherein the manifold is connected to the rear end of the container by being removably mounted on the platform.

7. The method of claim 1 wherein in step (c) the container is tilted to an angle about equal to the angle of repose of the bulk powder and as the powder discharges the angle of tilt is increased at intervals to allow the powder to discharge with out the use of vibrators.

8. The method of claim 1 wherein the tilt angle is equal to or less than the angle of repose and there are at least 3 vibrators, 2 of the vibrators are mounted as a pair, one directly opposite the other, and the third vibrator mounted along a container floor center line at a location between the front end of the container and the pair of vibrators.

9. The method of claim 1 wherein the tilt angle is equal to or less than the angle of repose and there are 5 vibrators wherein the vibrators are mounted so that there is a first pair of vibrators mounted at the rear end of the container, a second one pair of vibrators mounted approximately half-way between the front end and the rear end of the container, and the fifth vibrator mounted along a container floor center line at a location between the front of the container; and wherein the vibrators are activated in sequential patterns wherein in the first pattern, the fifth vibrator, the second pair and only one vibrator of the first pair of vibrators are activated together followed by the second pattern wherein the fifth vibrator, the second pair vibrators and the other vibrator of the first pair are activated together.

10. The method of claim 1 wherein in step (c) the container is tilted immediately at an angle greater than the angle of repose to discharge the bulk powder.

11. The method of claim 1 wherein the pneumatic conditioning membrane is formed from a microporous membrane material.

12. The method of claim 1 wherein the manifold is connected to the rear end of the container by being rigidly mounted on the platform.

13. The method of claim 1 wherein the bulk powder is stored in a standard, flexible liner within the container where the bulk powder is sealed being supported by a cardboard bulkhead.

* * * * *

UNITED STATES PATENT AND TRADEMARK OFFICE
Certificate

Patent No. 6,558,111 B2 Patented: May 6, 2003

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Catherine Marie Wilson, Wilmington, DE (US); Timothy Allan Bell, Wilmington, DE (US); John D. Connolly, Jr., Wilmington, DE (US); Peter Carl Clark, Diamond Head, MS (US); James E. Mothersbaugh, Muncy, PA (US); and Andrew P. Mitchell, Montoursville, PA (US).

Signed and Sealed this Eighth Day of April 2008.

SAUL J. RODRIGUEZ
*Supervisory Patent Examiner*
Art Unit 3652